US006358164B1

(12) United States Patent
Bracewell et al.

(10) Patent No.: US 6,358,164 B1
(45) Date of Patent: Mar. 19, 2002

(54) STRIKE ZONE INDICATOR MEASUREMENT DEVICE

(76) Inventors: Joseph S. Bracewell, 4554 Klingle St., NW.; Marvin Fabrikant, 5149 Tilden St., NW., both of Washington, DC (US) 20016

( * ) Notice: Subject to any disclaimer, the term of this patent is extended or adjusted under 35 U.S.C. 154(b) by 0 days.

(21) Appl. No.: 09/708,017

(22) Filed: Nov. 8, 2000

(51) Int. Cl.[7] ..... A63B 69/00
(52) U.S. Cl. ..... 473/454; 473/455
(58) Field of Search ..... 473/452–455, 473/152, 155, 192, 199; 773/371, 348; 463/1, 40–43

(56) References Cited

U.S. PATENT DOCUMENTS

| | | | | |
|---|---|---|---|---|
| 2,113,899 A | | 4/1938 | Oram | |
| 2,943,141 A | | 6/1960 | Knight | |
| 4,180,726 A | | 12/1979 | DeCrescent | |
| 4,515,365 A | | 5/1985 | Horikoshi et al. | |
| 4,545,576 A | | 10/1985 | Harris | |
| 4,563,005 A | | 1/1986 | Hand et al. | |
| 4,770,527 A | | 9/1988 | Park | |
| 5,230,505 A | | 7/1993 | Paquet et al. | |
| 5,401,016 A | | 3/1995 | Heglund et al. | |
| 5,493,112 A | | 2/1996 | Welch | |
| 5,509,649 A | | 4/1996 | Buhrkuhl | |
| 5,602,638 A | | 2/1997 | Boulware | |
| 5,676,607 A | | 10/1997 | Stumpf | |
| 5,769,713 A | * | 6/1998 | Katayama | 463/3 |
| 5,984,810 A | * | 11/1999 | Frye et al. | 473/455 |
| 6,031,545 A | * | 2/2000 | Ellenby et al. | 345/435 |
| 6,042,492 A | * | 3/2000 | Baum | 473/453 |
| 6,159,113 A | * | 12/2000 | Barber | 473/454 |

* cited by examiner

*Primary Examiner*—Jessica J. Harrison
*Assistant Examiner*—John M Hotaling, II
(74) *Attorney, Agent, or Firm*—James Creighton Wray; Meera P. Narasimhan

(57) ABSTRACT

A strike zone indicator apparatus has a mount positioned in relation to a home plate and away from possible interference. First projectors connected to the mount project first beams related to the home plate. A measurer takes particular individual players measurements and a processor connected to the measurer and to the first projectors creates individualized upper and lower limits of strike zones according to the particular individual players measurements. Second beam projectors are connected to the processor for projecting second beams intersecting with the first beams for establishing above the preexisting home plate the upper and lower limits and the strike zones based on the particular individual players measurements from the measurer.

8 Claims, 2 Drawing Sheets

STRIKE ZONE INDICATOR MEASUREMENT DEVICE

BACKGROUND OF THE INVENTION

In baseball and softball, the strike zone is a spacial volume over home plate. The sides are defined by the edges of the plate. The upper limit is a horizontal plane at the midpoint between the top of the shoulders and the top of the uniform pants of a batter. The lower limit is a horizontal plane through at the hollow beneath the knee cap of the batter. The strike zone is determined by the batter's stance as he or she prepares to hit a ball. Therefore, the strike zone varies depending on the height and stance of each batter.

Because the strike zone varies for each batter, and because the zone is defined only by imagined lines, it is often difficult to determine whether or not a ball was pitched through the strike zone. Umpires are relied upon to call a pitch as a ball or a strike, but umpires cannot accomplish this task perfectly for every pitch. Human error as well as variation between umpires may lead to balls and strikes being called incorrectly, inconsistently or erratically. Parallaxes and angles of viewing and corrections for those angles make the umpires decision process difficult.

Needs exist for improved aids and methods for immediate, exact, and repeatable differentiations between strikes and balls.

SUMMARY OF THE INVENTION

The present invention is an apparatus and method for aiding the detection and differentiation of balls and strikes in baseball and softball. The apparatus may be used in recreation league, major league, minor league, Little League, high school, college or Olympic baseball and softball games.

The present invention, a strike zone indicator, takes away the possibility of human error and variation among umpires when calling balls and strikes in baseball and softball. The strike zone indicator aids in the detection of balls and strikes by making empirical the 3-dimensional portion of air space that denotes the strike zone for each individual batter. The strike zone indicator uses laser technology, a hologram image, "virtual insertion," or computer technology to delineate the strike zone for each batter. When a pitch crosses home plate within the strike zone of a particular batter, the strike zone indicator will denote that the pitch was a strike; if a pitch misses the strike zone of a particular batter, a ball will be indicated. Swings made at pitches outside the strike zone do not affect the registry of the strike zone indicator, as only the intrusion of a ball is registered within the strike zone.

The vertical boundaries of the strike zone are defined by the perimeter of home plate. These fixed boundaries are delineated by imagery generated by using laser technology, a hologram, "virtual insertion," or computer technology from above home plate. In other embodiment project beams from or at home plate by generating the imagery up from the perimeter of home plate. The horizontal boundaries of the strike zone vary and are determined by measuring each player and generating imagery at the midpoint between the top of the shoulders and the top of the uniform pants and at the level of the hollow beneath the knees. The upper and lower delineating planes may be generated using the same process for defining the vertical components of the strike zone. Each batter may be measured before the baseball or softball game at a convenient time such as during a preseason physical or at picture day, or immediately pregame, for example, as the players stand for the National Anthem.

The measurements of each individual batter are recorded and are used when he or she bats; these measurements are adjusted according to the batting stance or crouch of the batter. Measurements may be taken of a batter in the ready circle. Previously taken measurements may be checked and updated at that position. Alternatively the measurements may be taken in situ while the batter is in the batter's box, using remote instruments for example located in stadium walls or near first and third base dugouts. In one embodiment, tape line implants or sensitized threads are affixed to the uniform at the upper and lower limits of the strike zone for each player.

The strike zone delineated by the strike zone indicator may be made visible to the participants of the baseball or softball game using a hologram, or may be invisible to participants. The strike zone indicator may be projected to viewers such as fans attending the game, television viewers, announcers and umpires by projection onto in-stadium displays, scoreboards, televisions, closed-circuit televisions, hand-held devices and other viewing means. This allows viewers of the projection to accurately determine if a pitch is a ball or a strike.

The strike zone indicator may be used by umpires to aid in calling difficult pitches, or it may totally replace umpires by automating the calling of balls and strikes. Additionally, the strike zone indicator may be used by announcers, analysts and viewers to determine the accuracy of an umpire's call.

The strike zone indicator may be visible only to umpires using special viewing devices. Sensors sensing a ball passing through or missing the zone may cause direct count indications or may provide tone signals broadcast to all or available only to an umpire as a call decision aid.

In addition to use during baseball and softball games, the strike zone indicator may be used as a practice tool. The strike zone indicator not only indicates if a pitch is a ball or a strike, but it is also capable of determining the precise placement of the ball within the strike zone. Pitchers, coaches, trainers and managers may use the strike zone indicator to analyze the placement and accuracy of pitches. This gives pitchers a tool to aid not only in throwing strikes, but also in throwing pitches through particular points of the strike zone where hits are less likely.

The strike zone indicator may also be used for amusement purposes, for example at batting cages, carnivals, amusement parks and fairs. In this way, the public would have access to analysis of pitching skill and accuracy.

A preferred embodiment of the strike zone indicator comprises a mechanism for generating and aiming laser beams onto or emanating from the boundaries of a home plate which is found in situ. From above home plate the mechanism is mounted high enough so as not to be an obstruction to the pitcher, batter, catcher, umpire or viewers of the baseball or softball game from below the perimeter of home plate would be projected in situ by lasers, computers or the like. In addition, an indicator is connected to this mechanism for displaying information about the location of the pitch, either within or outside of the strike zone.

An embodiment of the strike zone indicator comprises connecting the mechanism for generating and aiming laser beams to a means for projecting imagery of the strike zone onto in-stadium displays, scoreboards, televisions, closed-circuit televisions, hand-held devices and other viewing means.

The new strike zone indicator is used in baseball or softball to provide strike zone detection and a zone indicator.

It is useable indoors or outdoors and is portable. A preferred embodiment uses home plates found in situ. Created images can be projected to stadium audiences, television audiences, announcers or to home plate umpires by hand held devices. The new method uses "virtual insertion". Total accuracy is provided. Neither human error nor variation is introduced. The new system can replace or augment human umpires. The system can tell exactly where the ball entered the strike zone to improve "pitch placement" in practice. The system is used as a practice tool or on game day. There is no physical bar to the play of the game. No obstruction is presented. Information is continuously or repeatedly displayed.

Horizontal laser lines are projected at a midpoint between shoulder and belt and at the batter's hollow of the knees. Existing home plates are used. In-place lasers may be used at home plate. Hologram images are created by "virtual insertion" computer imagery and lasers. A 3D "cube" of air space is defined as the strike zone. Imagery is fixed from above home plate or at ground level. Batters are premeasured before games or at the starts of games. Horizontal "Lines" move to fit batter's stances. Swings of the bat do not affect the hologram accuracy. Only the ball is registered by the device.

To project the individualized strike zone for a batter that is accomplished either by use of a hologram image, "virtual insertion", computer or laser technology that makes empirical that cube of air space that denotes the "strike zone" for each batter. "Strike zone" is defined by official baseball rules as:

> "That area over home plate the upper limit of which is a horizontal line at the midpoint the top of the shoulders and the top of the uniform pants, and the lower level is a line at the hollow beneath the knee cap. The strike zone shall be determined from the batter's stance as the batter is prepared to swing at the pitched ball."

To accomplish the horizontal measurements required of . . . "line of the midpoint between the top of the shoulders and the top of the uniform pants, and the lower level is a line at the hollow beneath the knee cap."

The batter would be measured during preseason physical, on picture day and/or immediately pregame say as he stands to observe the National Anthem. Higher belt, belt buckle or a trouser button provides the point of reference for "the top of the uniform pants". Special threads can be stitched at the "top of the shoulders" of the uniform and/or at "the top of the uniform pants" to likewise provide the point of reference to determine the upper horizontal line of the strike zone. Likewise, "patches" may be affixed to the uniform by adhesive to highlight the "hollow of the knees". These measurements would be transposed and recorded so that when he/she assumes his/her stance and/or crouch in the batter's box those "lines" would move accordingly. The vertical lines are defined by the perimeter of home plate and likewise would be "fixed" by imagery from above home plate or at home plate by hologram, "virtual insertion", computer imagery or lasers.

Thence, the unique "cube" for each player having been defined the point of entry of the thrown pitch it can be empirically determined in said pitch is a "strike". Swings made at pitches outside this cube (strikes, tips or fouls) would not affect the registry of penetration. Only the ball's intrusion into the "cube" so defined would be registered by laser, hologram, "virtual insertion" or computer graphic. That image could be projected to the stadium audience, television audience, announcers and/or the home plate umpire using a hand held device.

These and further and other objects and features of the invention are apparent in the disclosure, which includes the above and ongoing written specification, along with the drawings.

DETAILED DESCRIPTION OF THE PREFERRED EMBODIMENTS

Figure 1:
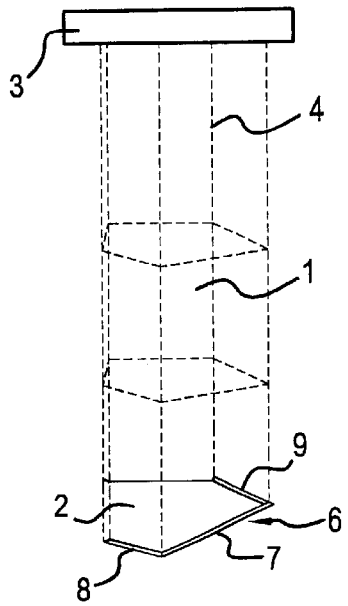
FIG. 1 is a schematic representation of the presentation of a virtual image of a strike zone.

Referring to FIG. 1, a virtual strike zone above home plate is generally indicated by the numeral 1. An existing home plate is generally indicated by 2. An image projector 3 positioned at a substantial distance above home plate vertically projects energy beams along all edges 6 of the home plate including the front edge 7 and the side edges 8 and 9. Energy beams 4 may be projected to the corners of home plate. Preferably the vertical energy beams 4 are projected all along the edges at intervals at least less than a diameter of a baseball. The same image projection may occur alternatively from below home plate 2.

Figure 2:
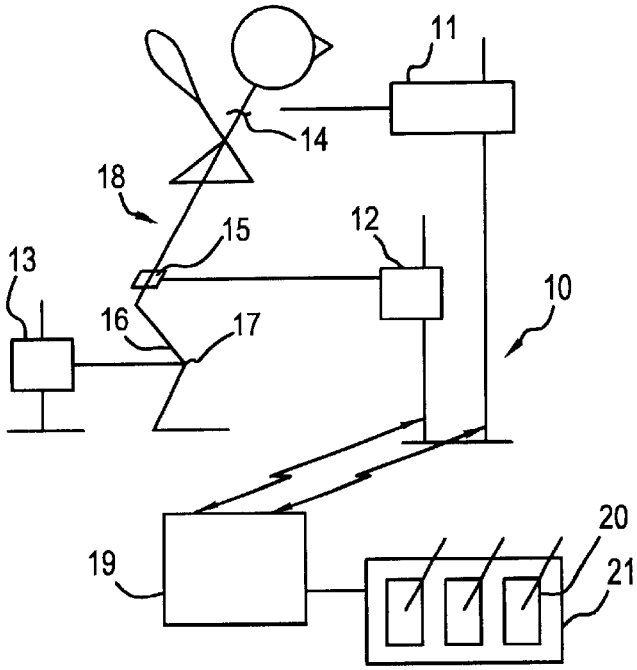
FIG. 2 is a schematic representation of measuring the heights of shoulders, belt and knees and calculation of vertical limits of the strike zone.

Preferably at some time prior to the entry into the batter's box an individual batter is premeasured in his batting stance through thread, stitching, patches, belts, buckles or buttons. The three key horizontal lines are established i.e., "the hollow below the knee", "the top of the shoulders" and "top of the pants". A measuring device 10 is shown in FIG. 2. The measuring device may have three laser beam projectors 11, 12 and 13 for projecting visible spots on the shoulders 14, belt 15 and the angle in 16 in back of the knees 17 of a batter 18 in his batting stance. The heights of the spot projectors 11, 12 and 13 may be manually or automatically adjusted so that the spots are correctly projected on the target. The heights at hollows of knees and the midpoint between the top of shoulder and top of pants are measured and manually or automatically are transferred to a controller 19. Alternatively the heights may be changed by servo motors using control sticks 20 in control box 21, which through controller 19 physically control the up and down movements of the spot projectors 11, 12 and 13.

As an alternative a calibrated measurer may be used to measure points 14, 15 and 16 on a batter 18 in his stance and the distance of those points above the ground may be entered in controller 19, which averages points 14 and 15. An input from controller 19 is provided to a processor 23 which controls projector 3.

Figure 3:
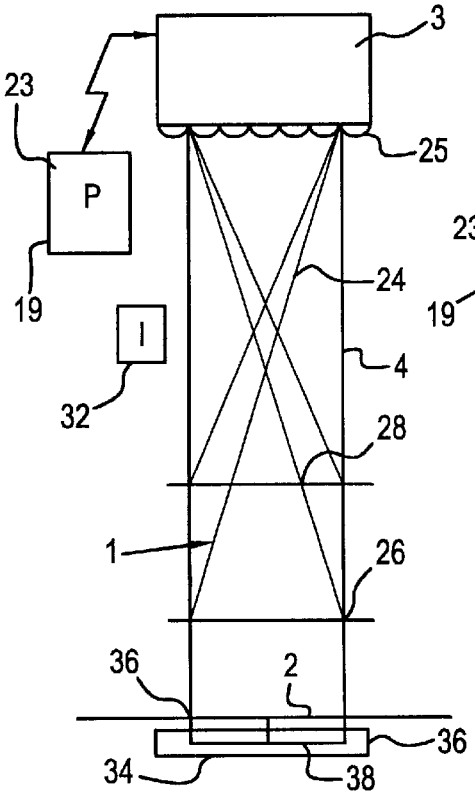
FIG. 3 is a schematic representation of energy beams creating a vertical image of a strike zone.

Referring to FIG. 3, in addition to the energy beams 4 along the edges of the plate, projector 3 projects energy beams 24 to intersect the energy beams 4 at locations above home plate 2 in planes 26 and 28. Sources 25 of beams 24 are moved with servo motors to create the individualized angles of beams 24 for an individualized strike zone according to a particular batter's measurements. Planes 26 and 28 correspond to the height of point 16 above the ground and to the height of point 15 plus one-half of the difference between points 15 and 14, respectively. The intersecting energy beams create a virtual image of home plate. The illumination of the virtual image of home plate may be within the visible spectrum once the angular beams 24 have intersected with the vertical beams. Alternatively the virtual image may be outside the visual spectrum. Sensors 30 (not shown) on the projector 3 sense changes in reflected energy consistent with baseballs having passed through the virtual strike zone. Coated or treated stitching on the baseball may provide an alternative method to trace the path of the ball through the "strike zone". The sensors provide information to the processor 23 which in turn provides information to the indicator 32. A projector 34 may be buried beneath home plate to project beams 4 from sources 36 upward along edges of the plate. Home plate 2 may be made of a translucent material, and sources 38 may project beams 4 and 24 upward through the plate.

Figure 4:
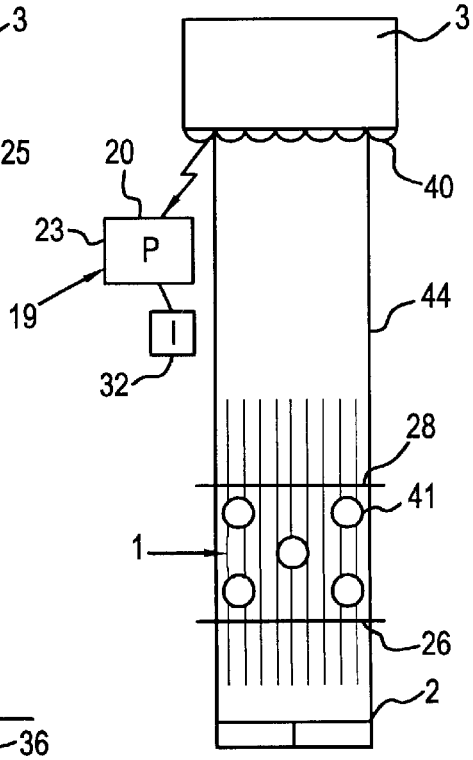
FIG. 4 is a schematic representation of creating a virtual image of a strike zone and sensing pitched balls passing through the virtual images of strike zone.

As shown in FIG. 4 projector 3 may be project vertical radar beams 44 and the processor 20 may provide indications of ranges indicating the lower and upper limits 26 and 28 of the strike zone 1. The transceivers 40 report reflections of energy from any ball 41 intersecting a beam 44 in the strike zone within the predetermined distances 26 and 28. All may be visible through 3-D type glasses worn as sunglasses, eliminating need for a "processor". In that case, only a projector is needed.

Figure 5:
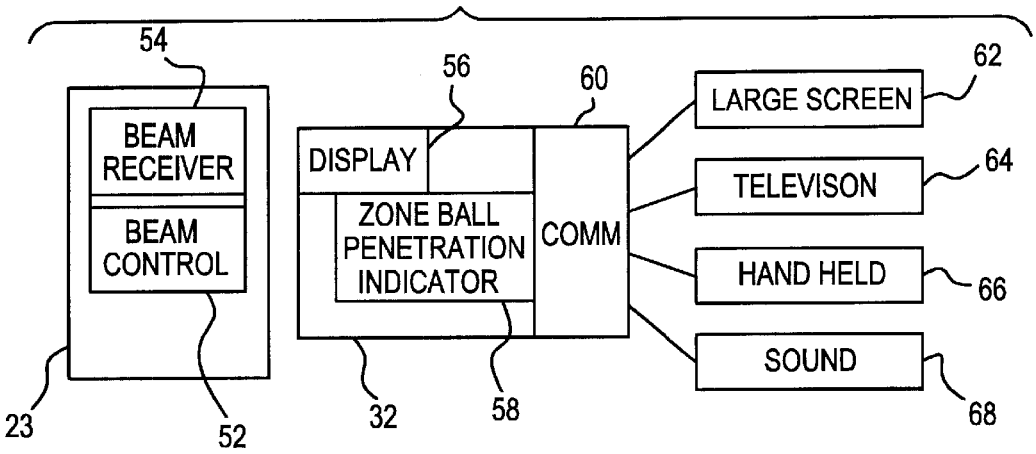
FIG. 5 is a schematic representation of a generator and receiver for connecting to the strike zone virtual image projector.
Figure 6:
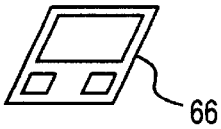
FIG. 6 shows a hand-held receiver.
Figure 7:
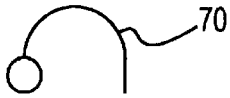
FIG. 7 shows a sound receiver.

In FIG. 5 the processor has a beams generator 52 and a beams receiver 54. The processor is connected to the indicator 32 which includes a display driver 56 and a zone-ball penetration indicator 58. The display 56 and the zone-ball penetration indicator are connected to a communications section 60, which provides the images and indication to a large screen on site 62 at television transmitter 64, a hand-held receiver 66 and a sound generator 68. A hand-held receiver 66 is generally shown in FIG. 6. A sound receiver 70 may be worn by an umpire to provide differentiated tones for strikes and balls, as shown in FIG. 7.

In addition to receiving the display and indication from the communicator 60, the large screen 62 and transmitter 64 may be supplied by visually imaging the strike zone 1 such as shown in FIG. 3. When the strike zone is shown in the visible spectrum. Alternatively camera sensors for the large screen television reproduction may pick up images created outside of the visible spectrum, such as, for example, infrared images.

While the invention has been described with reference to specific embodiments, modifications and variations of the invention may be constructed without departing from the scope of the invention, which is defined in the following claims.

We claim:

1. Strike zone indicator apparatus comprising a measurer for premeasuring multiple individual baseball players in batting stances, the measurer further comprising a shoulder height measurement provider, a belt height measurement provider and a knee hollow measurement provider and a processor connected to the measurement providers for receiving measurements and a recorder connected to the processor for separately recording distinct measurements of the multiple individual baseball players.

2. The apparatus of claim 1 and the processor further includes a calculator for calculating upper and lower limits of strike zones of the multiple individual baseball players and wherein the recorder records the upper and lower limits of the strike zones for the multiple individual baseball players.

3. The apparatus of claim 2, wherein the processor further comprises a communicator for communicating the upper and lower limits of the strike zone of the multiple individual baseball players to local processors connected to projectors mounted near home plates.

4. The apparatus of claim 3, wherein the communicator comprises recorded media.

5. The apparatus of claim 3, wherein the communicator comprises a network interconnecting the processors.

6. A strike zone indicator apparatus comprising mount positioned in relation to a plate away from possible interference with players, umpires and spectators, projectors connected to the mount and positioned with respect to an existing home plate for projecting energy beams related to the home plate, receivers mounted near the home plate for receiving energy from the energy beams and processors connected to the receivers and providing information therefrom according to pitched baseballs traveling through the energy beams, further comprising an input connected to the processor for providing information on particular upper and lower strike zone limits of a particular batter standing along the home plate, further comprising a comparator connected to the processor for comparing the particular limits of the strike zone of the particular batter with energy received in the receivers.

7. The apparatus of claim 6, further comprising filters connected to the processor for filtering out energy received in the receivers from objects larger or smaller than a baseball.

8. The apparatus of claim 6, wherein the energy is projected in pulses from the projectors, and wherein the receivers are positioned for receiving reflected energy.

* * * * *